US006450510B1

(12) United States Patent
Liu

(10) Patent No.: US 6,450,510 B1
(45) Date of Patent: Sep. 17, 2002

(54) IN-LINE ROLLER SKATE HAVING ADJUSTABLE TOE PORTION

(75) Inventor: Shi Pei Liu, Chong Ho (TW)

(73) Assignee: European Sports Enterprise Co., Ltd., Taipei Hsien (TW)

( * ) Notice: Subject to any disclaimer, the term of this patent is extended or adjusted under 35 U.S.C. 154(b) by 0 days.

(21) Appl. No.: 10/081,365

(22) Filed: Feb. 19, 2002

Related U.S. Application Data

(63) Continuation-in-part of application No. 09/968,876, filed on Oct. 3, 2001, now abandoned.

(51) Int. Cl.[7] ..... A63C 17/00

(52) U.S. Cl. ..... 280/11.26; 36/97; 36/115; 280/11.231

(58) Field of Search ..... 74/422; 36/97, 36/115, 117.7; 280/11.221, 11.231, 11.26, 11.27, 11.28, 11.3, 7.13

(56) References Cited

U.S. PATENT DOCUMENTS 3,309,098 A * 3/1967 Parker ..... 280/11.26
4,684,140 A * 8/1987 Olivieri ..... 280/11.26
5,193,827 A 3/1993 Olson ..... 280/7.13
5,484,149 A * 1/1996 Lee ..... 280/11.26
5,645,288 A * 7/1997 Lu ..... 280/11.26
5,836,592 A * 11/1998 Chang ..... 280/11.26
5,842,293 A * 12/1998 Yooung ..... 36/97
5,913,526 A * 6/1999 Olson et al. ..... 280/11.26
5,931,478 A * 8/1999 Chang ..... 280/11.26
6,045,144 A * 4/2000 Wong ..... 280/11.26
6,217,039 B1 * 4/2001 Iverson et al. ..... 280/11.26
6,247,707 B1 6/2001 Conte ..... 280/11.221
6,276,697 B1 8/2001 Lin ..... 280/11.26

* cited by examiner

*Primary Examiner*—Michael Mar

(57) ABSTRACT

A roller skate includes a frame having a slot and a lateral orifice formed in a front portion and communicating with each other, and a number of cavities formed around the orifice of the frame. A heel portion is secured on the frame. A toe portion includes a rack slidably received in the frame, and two fasteners for limiting the sliding movement between the toe portion and the heel portion. A gear is rotatably disposed in the frame and engaged with the rack of the toe portion. A knob is keyed to the gear for rotating the gear to adjust the toe portion relative to the heel portion.

5 Claims, 7 Drawing Sheets

IN-LINE ROLLER SKATE HAVING ADJUSTABLE TOE PORTION

The present invention is a continuation-in-part of U.S. patent application Ser. No. 09/968,876, filed Oct. 3, 2001, now abandoned.

BACKGROUND OF THE INVENTION

1. Field of the Invention

The present invention relates to a roller skate, and more particularly to an in-line roller skate having an adjustable toe portion.

2. Description of the Prior Art

U.S. Pat. No. 5,193,827 to Olson discloses one of the typical roller skates including a shoe body that may be changeably secured or attached onto an in-line roller frame or an ice blade, with a fastener bolt. The shoe body includes a fixed shape and a fixed length that may not be changed or adjusted to different lengths for receiving feet of different lengths.

U.S. Pat. No. 6,247,707 to Conte discloses the other typical roller skate including a heel portion that may be adjustably secured onto an in-line roller frame with an engagement between a toothed stem and a toothed tab. The toothed stem should be rotated with one end thereof, and should be locked to the frame with teeth of another tab which is pivotally secured to the other end of the toothed stem, such that the toothed stem may not be easily and quickly operated, and should be operated with both hands of the users.

U.S. Pat. No. 6,276,697 to Lin discloses a further typical roller skate including a toe portion that may be adjustably secured onto a heel portion, with a spring biased positioning device. However, the spring biased positioning device may not be easily disengaged from the toe portion and may not be quickly engaged onto the toe portion again, such that the toe portion may not be easily and quickly adjusted relative to the heel portion.

The present invention has arisen to mitigate and/or obviate the afore-described disadvantages of the conventional roller skates.

SUMMARY OF THE INVENTION

The primary objective of the present invention is to provide an in-line roller skate including an adjustable toe portion that may be easily and quickly adjusted relative to the heel portion.

In accordance with one aspect of the invention, there is provided a roller skate comprising a frame including a front portion having a slot formed therein, and having an orifice laterally formed therein and communicating with the slot of the frame, the frame including a rear portion, and including a plurality of cavities formed around the orifice of the frame, a heel portion secured on the rear portion of the frame, and including a front portion having a pair of oblong holes formed therein, a toe portion including a rack slidably received in the slot of the frame, and including two sides each having an aperture formed therein and aligned with the oblong holes of the heel portion respectively, two fasteners engaged through the apertures of the toe portion and the oblong holes of the heel portion respectively, for limiting a sliding movement of the toe portion relative to the heel portion, a gear rotatably provided in the frame, and including a bore and a groove formed therein and communicating with each other and aligned with the orifice of the frame, a knob including a shaft engaged through the orifice of the frame and engaged into the bore of the gear, and including a key extended from the shaft and engaged into the groove of the gear for allowing the gear to be rotated by the knob, and for allowing the rack and thus the toe portion to be adjusted relative to the frame and the heel portion by rotating the knob, and the knob including a projection extended therefrom for selectively engaging with the cavities of the frame, and for positioning the knob and the gear to the frame at any selected angular position. The gear may be rotated by the knob with only one hand of the user and on only one side of the roller skate.

The knob includes an engaging hole formed therein for receiving a driving tool which may be used to rotate the knob and thus the gear relative to the frame and the heel portion.

The heel portion includes a pair of flaps extended from the front portion thereof, the oblong holes of the heel portion are formed in the flaps respectively.

The frame includes a pair of wings extended therefrom, the orifice of the frame is formed through the wings of the frame, the gear is rotatably disposed between the wings of the frame. The cavities of the frame are formed in one of the wings and formed around the orifice of the frame.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 2:
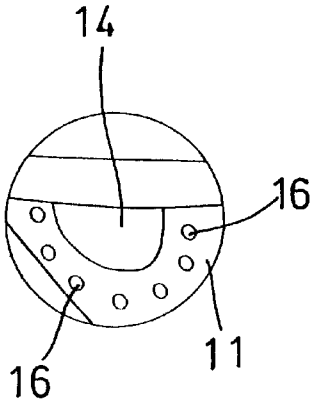
FIG. 2 is an enlarged partial perspective view showing a portion of a roller frame of the in-line roller skate.
Figure 1:
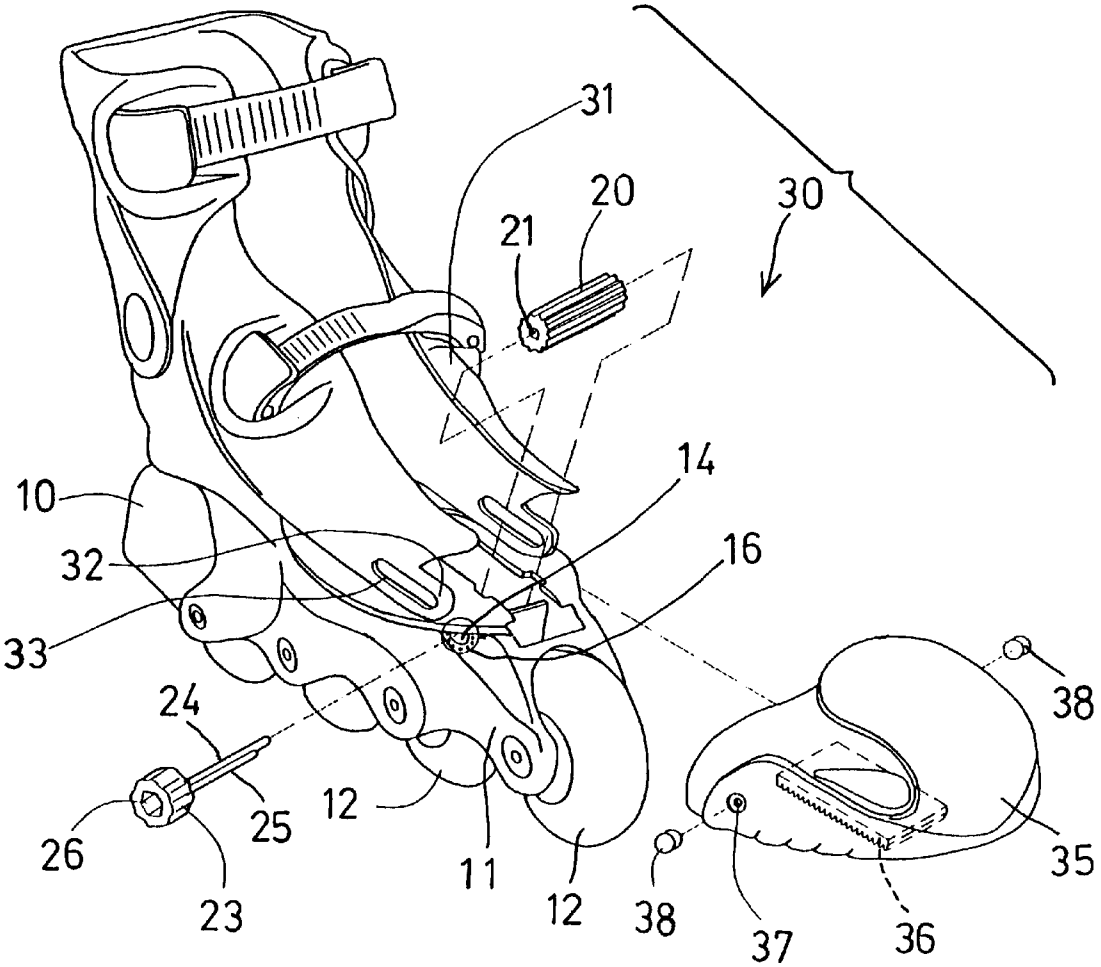
FIG. 1 is a partial exploded view of an in-line roller skate in accordance with the present invention.
Figure 3:
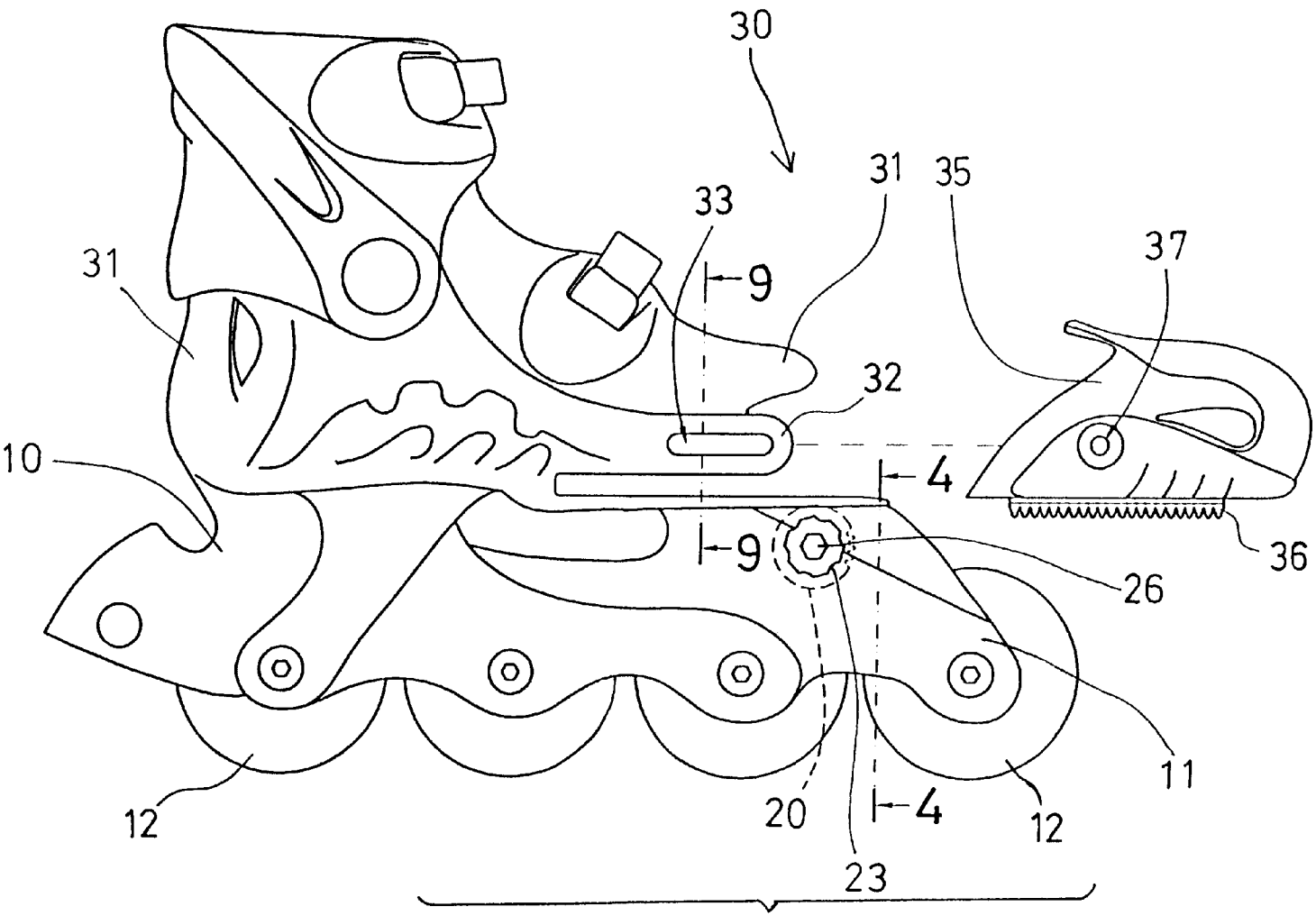
FIG. 3 is a plan and partial exploded view of the in-line roller skate.
Figure 4:
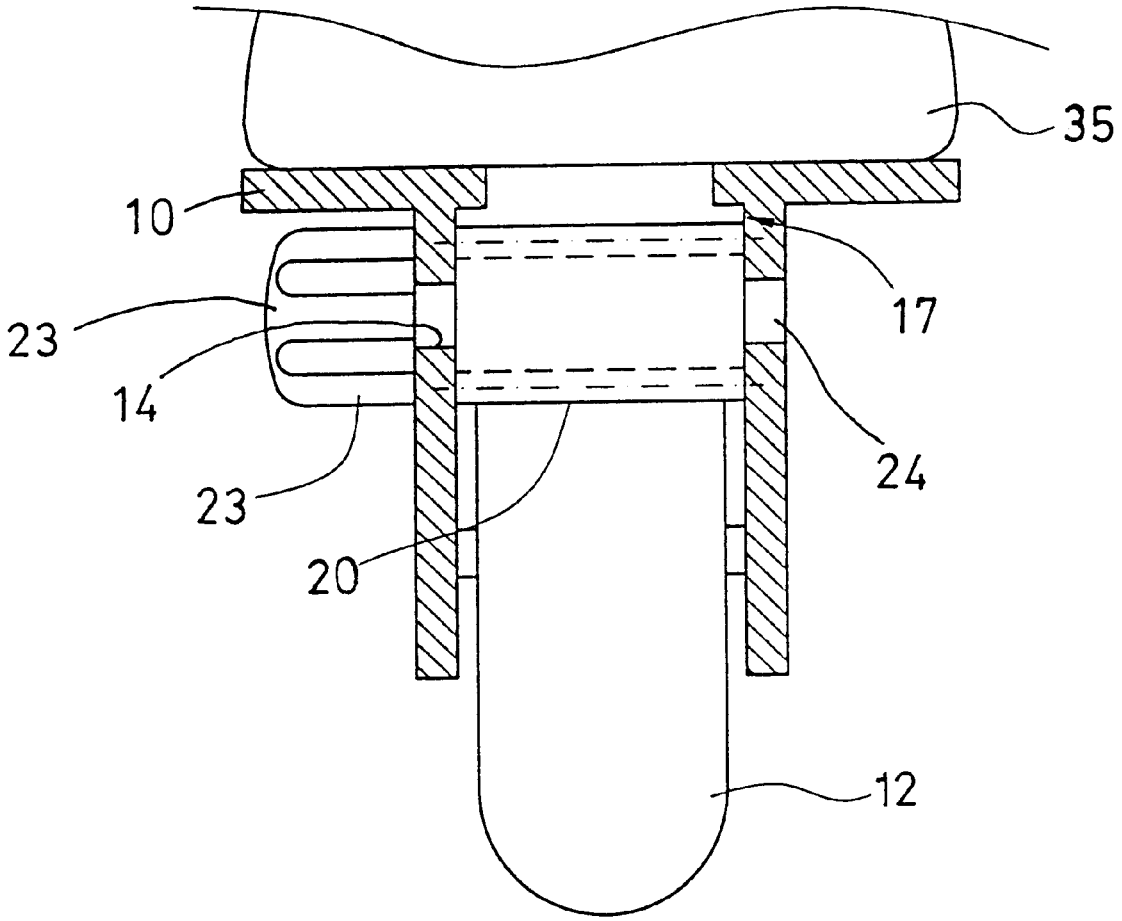
FIG. 4 is a partial cross sectional view taken along lines 4—4 of FIG. 3.
Figure 5:
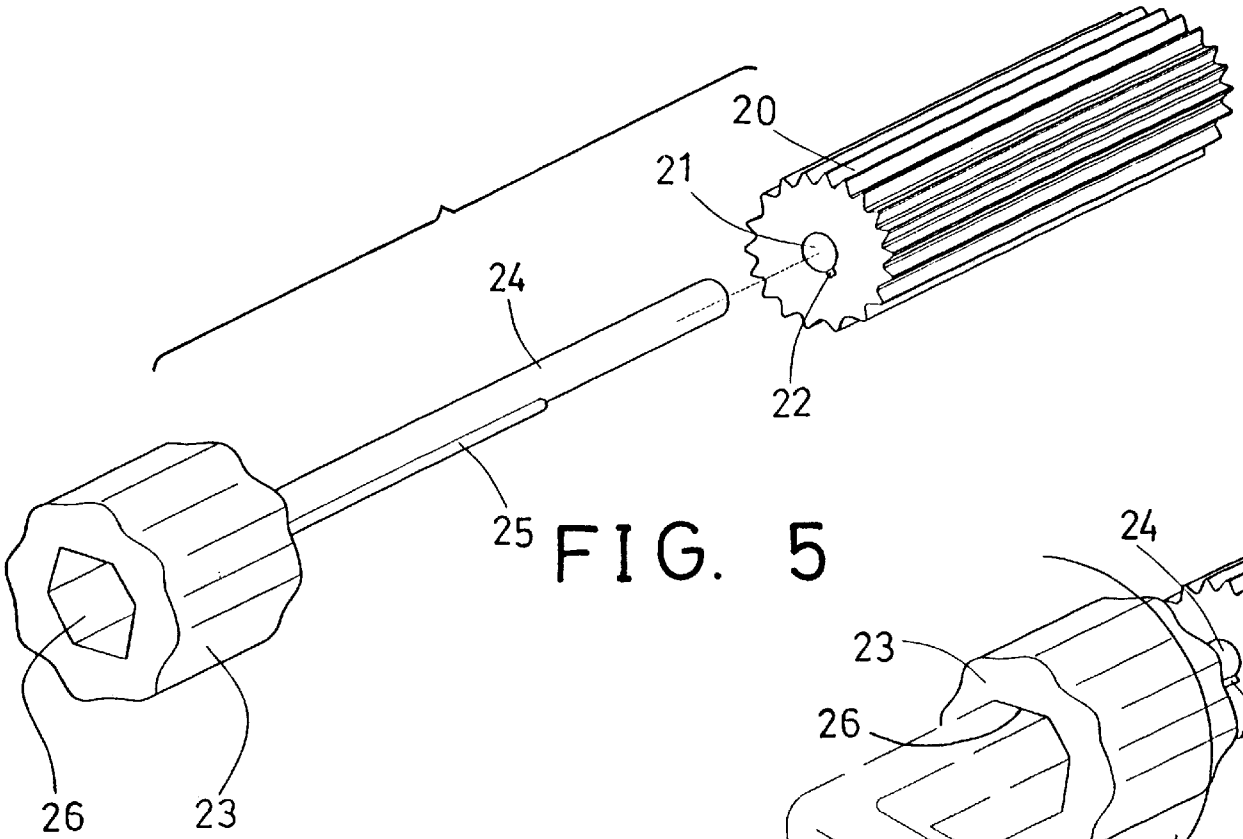
FIG. 5 is an enlarged-partial exploded view illustrating an adjusting device of the roller skate.
Figure 6:
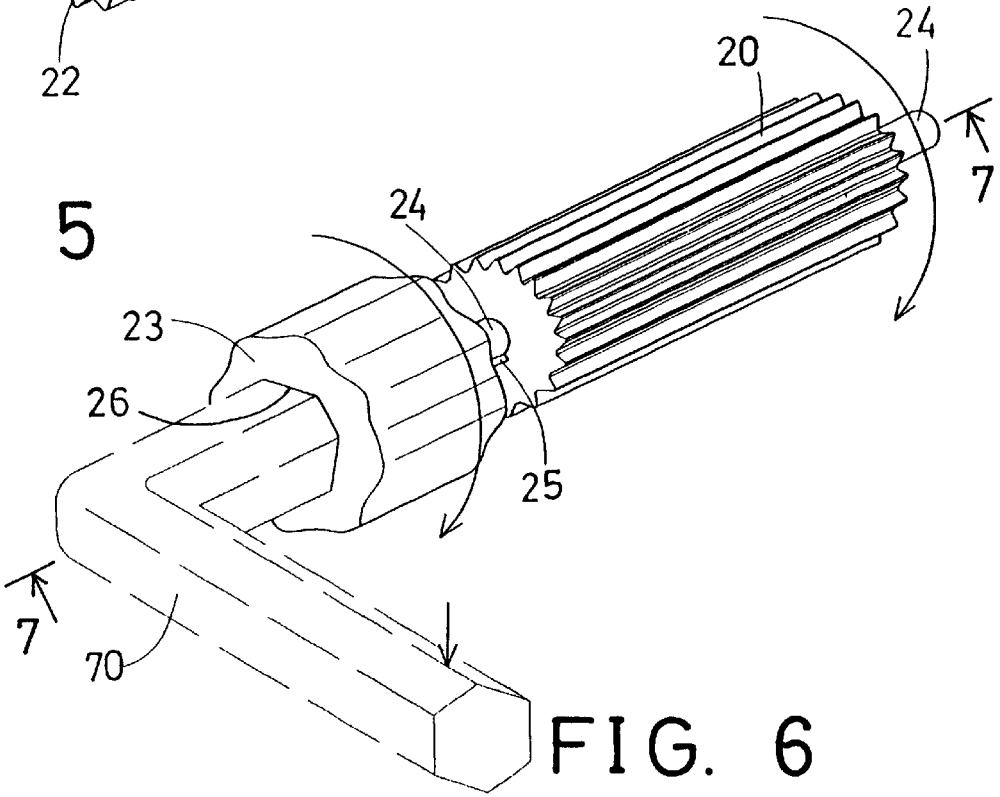
FIG. 6 is an enlarged partial perspective view of the adjusting device of the roller skate as shown in FIG. 5.
Figure 8:
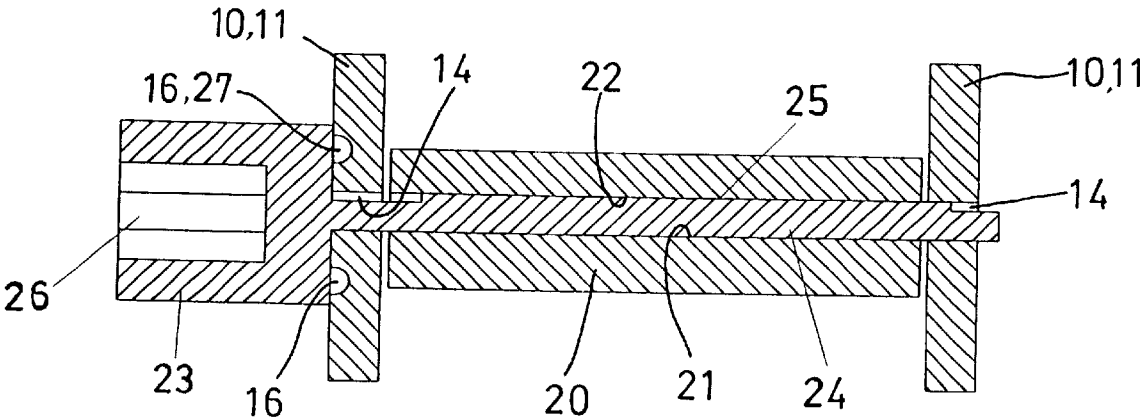
FIG. 8 is a cross sectional view similar to FIG. 7, illustrating the operation of the adjusting device of the roller skate.
Figure 9:
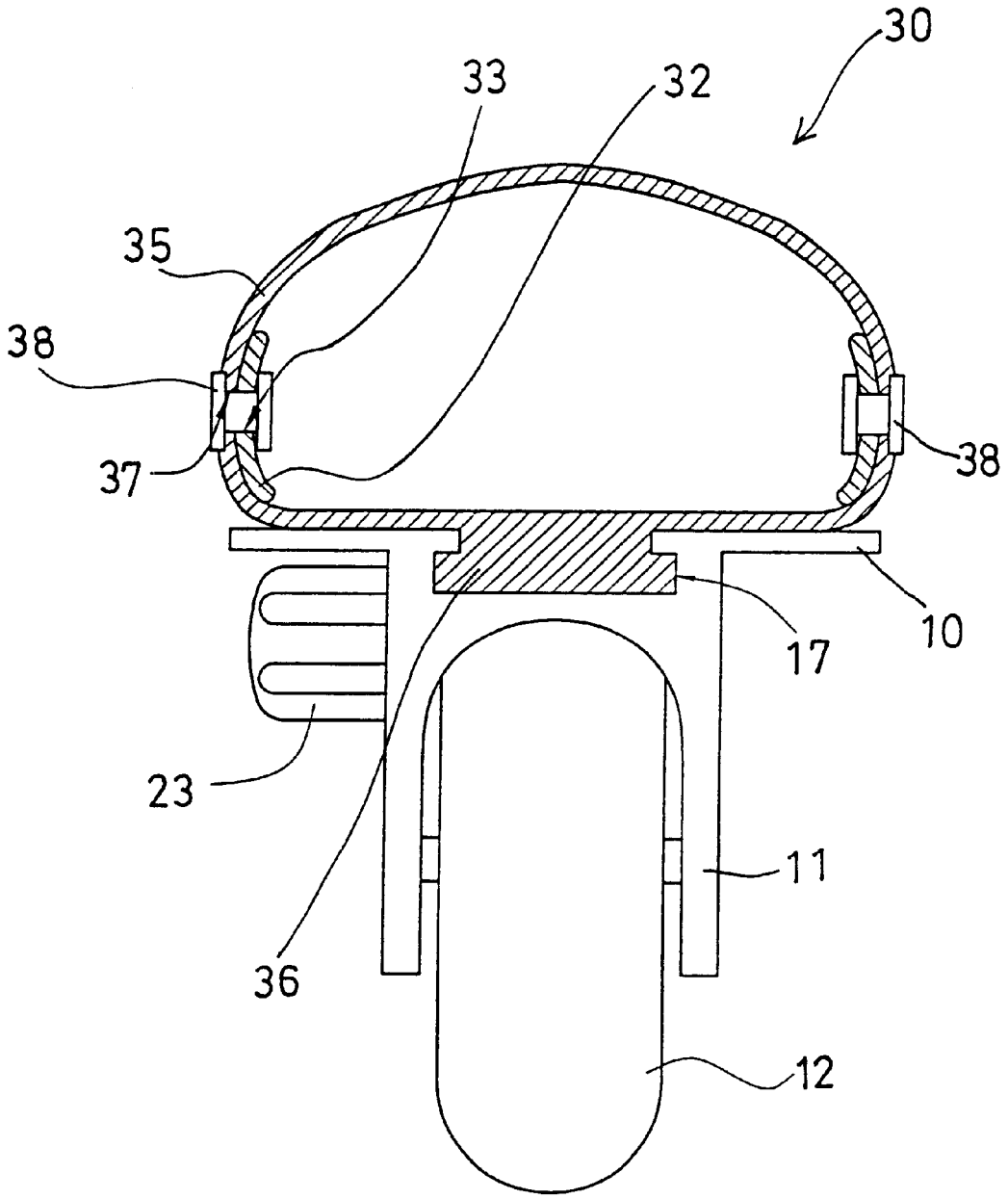
FIG. 9 is a partial cross sectional view taken along lines 9—9 of FIG. 3.
Figure 10:
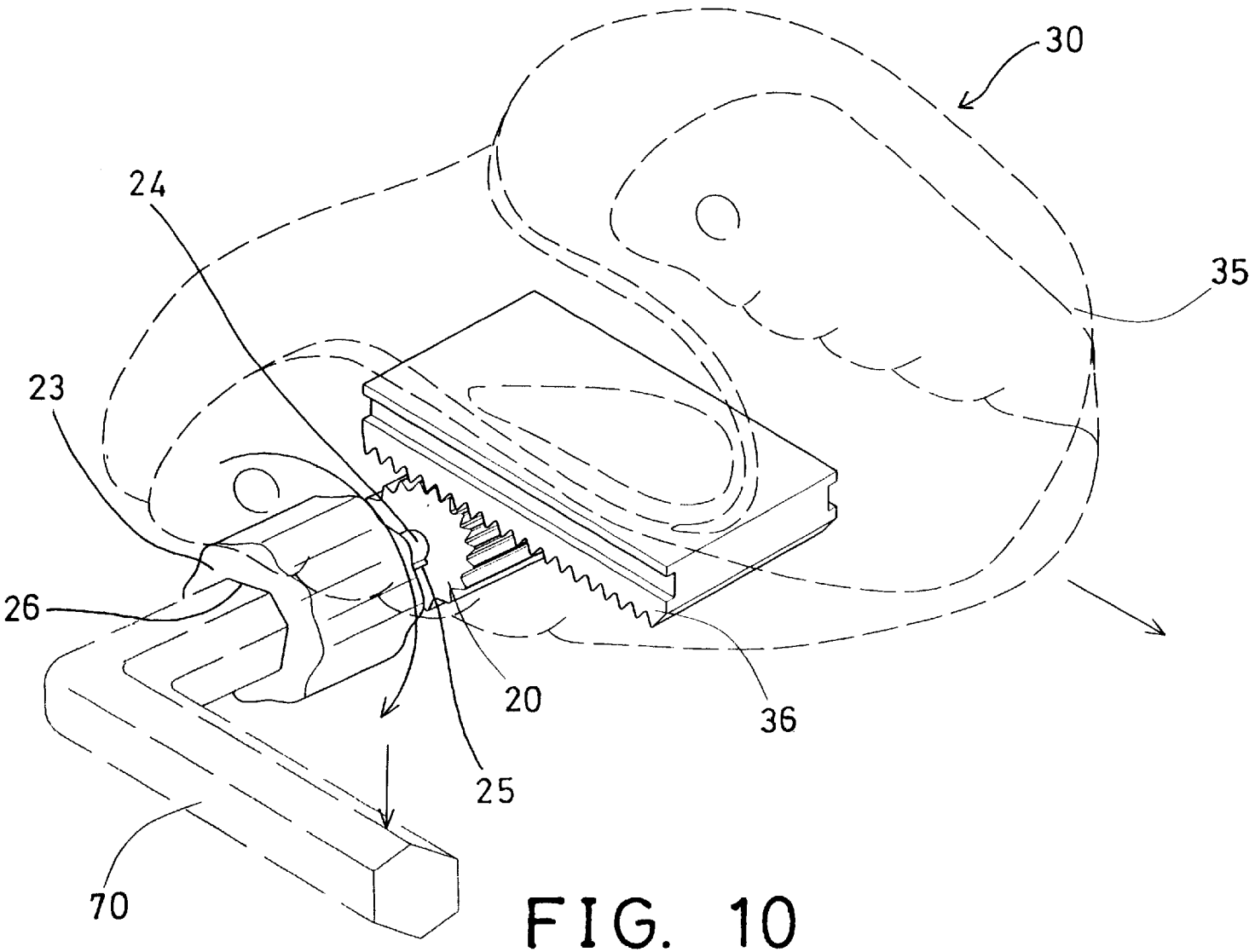
FIG. 10 is an enlarged partial perspective view illustrating the operation of the adjusting device of the roller skate.

Referring to the drawings, and initially to FIGS. 1–4, and 9, an in-line roller skate in accordance with the present invention comprises a roller frame 10 including a pair of wings 11 extended downward and parallel to each other, best shown in FIGS. 4 and 9. Two or more wheels 12 are rotatably secured between the wings 11 for forming an in-line roller structure. An ice blade may also be secured to the frame 10 for forming an ice skate. The frame 10 includes an orifice 14 laterally formed in the front portion thereof, such as formed through the wings 11 thereof, best shown in FIGS. 4, 7, 8, and includes a number of cavities 16 formed therein and arranged around the orifice 14 thereof, best shown in FIG. 2. For example, the cavities 16 of the frame 10 may be formed in one of the wings 11. The frame 10 further includes a slot, such as a dove-tail slot 17 formed in the front portion thereof (FIGS. 4, 9), and communicating with the orifice 14 of the frame 10.

A toothed stem or a gear 20 is rotatably disposed between the wings 11 of the frame 10, and includes a bore 21 and a groove 22 formed therein and communicating with each other, and aligned with the orifice 14 of the frame 10. A knob 23 includes a shaft 24 engaged through the orifice 14 of the frame 10 and the bore 21 of the gear 20, and includes a key 25 extended from the shaft 24 and engaged into the groove 22 of the gear 20 for allowing the gear 20 to be rotated by the knob 23. The knob 23 includes an engaging hole 26 formed therein for receiving a driving tool 70 which may rotate the knob 23 in order to rotate the gear 23 relative to the frame 10. The knob 23 includes a projection 27 extended therefrom for selectively engaging with either of the cavities 16 of the frame 10 (FIGS. 7, 8), and for positioning the gear 20 to the frame 10 at the required or selected angular position.

A shoe device 30 includes a heel portion 31 solidly secured or attached on top of the frame 10. The heel portion 31 includes a pair of flaps 32 extended or provided on the front portion thereof, and each having an oblong hole 33 formed therein and substantially parallel to the frame 10 or to be parallel to the supporting ground. A toe portion 35 is to be slidably secured to the heel portion 31 and includes a toothed plate or a rack 36 slidably received or engaged in the dovetail slot 17 of the frame 10 and engaged with the gear 20, such that the gear 20 may be rotated to move the rack 36 and the toe portion 35 relative to the frame 10 and the heel portion 31. The toe portion 35 includes two sides each having an aperture 37 formed therein and aligned with the oblong holes 33 of the flaps 32. Two fasteners, such as rivets 38 are engaged through the apertures 37 of the toe portion 35 and the oblong holes 33 of the heel portion 31, best shown in FIG. 9, for limiting the sliding movement of the toe portion 35 relative to the heel portion 31.

Figure 7:
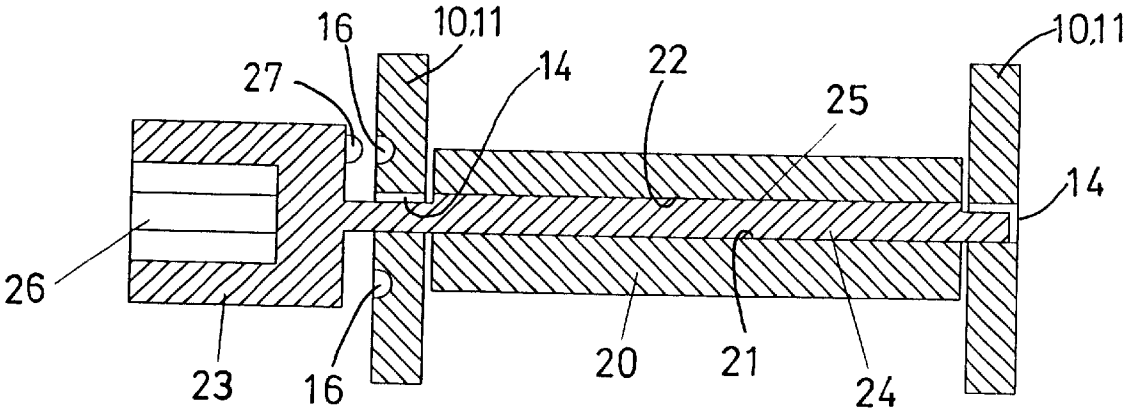
FIG. 7 is a cross sectional view taken along lines 7—7 of FIG. 6.

In operation, as shown in FIGS. 6–10, the knob 23 may first be pulled or moved relative to the frame 10 for disengaging the projection 27 thereof from the cavities 16 of the frame 10 (FIG. 7). The knob 23 and thus the gear 20 may be rotated relative to the frame 10 with a driving tool 70 (FIGS. 6, 10), in order to move and to adjust the rack 36 and the toe portion 35 relative to the frame 10 and the heel portion 31. After the rack 36 and the toe portion 35 have been adjusted relative to the frame 10 and the heel portion 31 to the required or selected position by rotating the knob 23 and the gear 20, the knob 23 may be forced onto or against the frame 10 in order to engage the projection 27 into the selected cavities 16 of the frame 10 (FIG. 8), and in order to position the gear 20 to the frame 10 at the required or selected or adjusted angular position.

It is to be noted that the knob 23 may be pulled or disengaged from the frame 10, and then rotated relative to the frame 10, and then forced against the frame 10 for engaging the projection 27 into the selected cavities 16 of the frame 10. The users may easily operate the knob 23 with only one hand, and at only one side of the in-line roller skate. The knob 23 preferably includes a non-circular outer shape or a serrated outer shape for allowing the knob 23 to be rotated manually without the driving tool 70.

Accordingly, the in-line roller skate in accordance with the present invention includes an adjustable toe portion that may be easily and quickly adjusted relative to the heel portion.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A roller skate comprising:

a frame including a front portion having a slot formed therein, and having an orifice laterally formed therein and communicating with said slot of said frame, said frame including a rear portion, and including a plurality of cavities formed around said orifice of said frame, a heel portion secured on said rear portion of said frame, and including a front portion having a pair of oblong holes formed therein, a toe portion including a rack slidably received in said slot of said frame, and including two sides each having an aperture formed therein and aligned with said oblong holes of said heel portion respectively, two fasteners engaged through said apertures of said toe portion and said oblong holes of said heel portion respectively, for limiting a sliding movement of said toe portion relative to said heel portion, a gear rotatably provided in said frame and engaged with said rack of said toe portion, and including a bore and a groove formed therein and communicating with each other and aligned with said orifice of said frame, a knob formed on one end of a shaft, said shaft extending through said orifice of said frame and through into said bore of said gear, and including a key member extending from said shaft and engaged within said groove of said gear for allowing said gear to be rotated by said knob, and for allowing said rack and thus said toe portion to be adjusted relative to said frame and said heel portion by rotating said knob, and said knob including a projection extended therefrom said shaft being selectively movable within said gear along a longitudinal axis of said bore between a released position, in which said projection is spaced from said cavities for permitting rotation of said knob together with said gear relative to said frame, and a locked position, in which said projection is received within a selected one of said cavities surrounding said orifice for preventing rotation of said knob relative to said frame.

2. The roller skate according to claim 1, wherein said knob includes an engaging hole formed therein for receiving a driving tool.

3. The roller skate according to claim 1, wherein said heel portion includes a pair of flaps extended from said front portion thereof, said oblong holes of said heel portion are formed in said flaps respectively.

4. The roller skate according to claim 1, wherein said frame includes a pair of wings extended therefrom, said orifice of said frame is formed through said wings of said frame, said gear is rotatably disposed between said wings of said frame.

5. The roller skate according to claim 4, wherein said cavities of said frame are formed in a first of said wings and formed around said orifice of said frame.

* * * * *